US005347755A

United States Patent [19]

Jaster et al.

[11] Patent Number: 5,347,755

[45] Date of Patent: Sep. 20, 1994

[54] AUTOMATICALLY ACTUATED DOOR ARRANGEMENT

[75] Inventors: Dale R. Jaster, Northlake; Russell J. Vestuto, Chicago; Ronald S. Maruszak, Willowbrook, all of Ill.

[73] Assignee: Ready Metal Manufacturing Company, Chicago, Ill.

[21] Appl. No.: 19,797

[22] Filed: Feb. 19, 1993

[51] Int. Cl.[5] ..... E05F 15/20; E05C 7/06

[52] U.S. Cl. ..... 49/25; 49/13; 49/28; 49/29; 49/118; 49/123; 49/138; 49/231; 49/280

[58] Field of Search ..... 49/25, 26, 28, 27, 118, 49/123, 29, 13, 14, 231, 280, 289, 300, 138

[56] References Cited

U.S. PATENT DOCUMENTS

| | | | |
|---|---|---|---|
| 2,989,302 | 6/1961 | Clark | 49/231 X |
| 3,051,281 | 8/1962 | Huff, Jr. | 49/25 X |
| 3,834,081 | 9/1974 | Catlett | 49/138 X |
| 4,142,326 | 3/1979 | Schmitz | 49/118 |
| 4,376,971 | 3/1983 | Landgraf et al. | 49/28 X |
| 4,503,637 | 3/1985 | Parente | 49/118 X |
| 4,658,545 | 4/1987 | Ingham et al. | 49/29 X |
| 4,674,231 | 6/1987 | Radek et al. | 49/118 |
| 4,771,218 | 9/1988 | McGee | 49/300 |
| 5,019,758 | 5/1991 | Jones et al. | 49/118 X |
| 5,191,268 | 3/1993 | Duhame | 49/25 X |

*Primary Examiner*—Philip C. Kannan
*Attorney, Agent, or Firm*—Dvorak and Traub

[57] ABSTRACT

An automatically actuated door arrangement is provided. The arrangement includes a plurality of slidable doors which are opened and closed by an electric motor/cable arrangement. Open and close switches control the opening and closing of the doors. A sensor device provides the open doors/close doors signals to the controller, and eventually to the motor. The motor is connected to the cable drive by a clutch arrangement which allows slippage should the movement of the doors become obstructed. The door travel path may be arranged in a slight V-shape, to allow for more efficient sealing of the door bottoms. A controller is provided to receive, process, and distribute electronic signals for controlling the extent of the door opening, the speed of opening and closing, and other operating parameters. The controller includes a series of indicators for monitoring the status of the door arrangement, and also includes inputs for altering the operating parameters of the door arrangement.

8 Claims, 3 Drawing Sheets

AUTOMATICALLY ACTUATED DOOR ARRANGEMENT

BACKGROUND OF THE INVENTION

Automatically actuated door arrangements have been known and used in the past. Typically, these devices have relied on the application of a physical force to mechanically slide open the doors, as in U.S. Pat. No. 4,411,102. Others utilize swinging doors which pivot outward, as in U.S. Pat. No. 4,442,630. Still others utilize magnetic materials to actuate movement of the doors, as in U.S. Pat. No. 4,674,231.

However, problems have been encountered with certain aspects of prior art devices. Particularly, none of the prior art devices provide for a fully automatic sliding door arrangement which is actuated without the application of a physical force input by the operator. The prior art devices all require a physical input by the operator. The prior art devices all require a physical input to actuate the door-opening movement. The necessity of a physical input detracts from the ability of the operator to perform other tasks, such as serving merchandise to customers and receiving payment through the door arrangement. Also, the speed and manner of door operation all affect the efficiency of the operator's actions. Factors such as speed of doors opening, opening sizes, and door sealing ability have been problematic in prior arrangements. Doors which stick open, or fail to close entirely, give rise to an uncomfortable and inefficient working environment for the operator, particularly in inclement weather. Also, because prior arrangements lack mechanisms for the detection of malfunctions, problem diagnosis in the past has been difficult.

SUMMARY OF THE INVENTION

The present invention overcomes the foregoing problems and others long associated with door controls by utilizing a completely automatic opening and closing mechanism, a carefully controlled opening and closing rate, a low friction door path, a weatherproof sealing arrangement, and an automated electronic diagnostic and control system. A sensor detects the presence of the operator approaching the doors, and sends a signal to the controller to open the doors at a controlled rate and to a preselected opening size.

The doors open at a relatively high rate of speed to facilitate the transfer of materials from the operator to the customer, in the case of a "drive-through" window. After the transaction, the operator withdraws from the window area. The movement of the operator away from the window is detected by the sensor. A signal is sent to the controller to begin closing the doors at a rate lower than the initial opening rate. This lower rate allows the operator to safely withdraw from the open window area.

The doors continue closing, unless obstructed during the closing movement. If, for example, the operator's arm remains in the open window area, the closing doors will gently impinge on the arm, and will then reverse direction and begin opening. If, however, an obstruction occurs in the last part of the door closure movement, the doors will not reverse direction, but will attempt to complete closure. This feature assures a tight seal between the respective doors, as well as the bottom seal area.

If a significant obstruction is encountered during the last part of door closure movement, a clutch mechanism in the drive motor arrangement will allow slippage of the drive, so that the doors will not close completely until the obstruction is removed or remedied.

A control unit/indicator panel facilitates diagnosis of and control over the door arrangement. In one embodiment, individual lamps are provided for motor run, beam break, close detect, current detect, and power indication. Switches are provided for beam test, window size selection, and delay time selection.

BRIEF DESCRIPTION OF THE DRAWINGS

The advantages and further aspects of the present invention will be readily appreciated by those having ordinary skill in the art by reference to the following detailed description in connection with the accompanying drawings in which.

DETAILED DESCRIPTION

Figure 1:
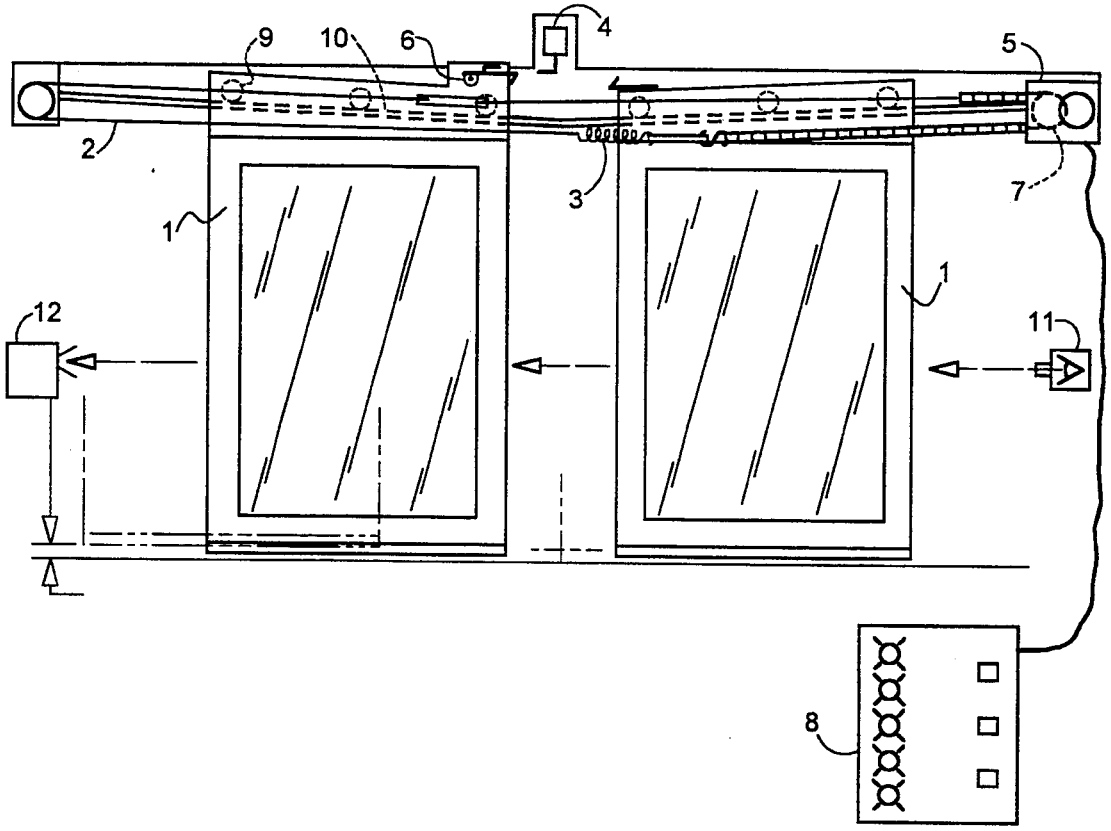
FIG. 1 is a front elevation view of the automatic door arrangement.

Referring now to the drawings in which like reference characters refer to like or corresponding parts throughout the several views, there is shown in FIG. 1 a front elevation view of the present invention. The doors 1 include door bearings 9 which ride in a door track 10. Latch 6 maintains the doors 1 in a locked together position until such time as the solenoid 4 disengages the latch 6. A drive cable 2 and spring assembly 3 are attached to the doors 1, and also the drive motor 5 and clutch 7 assembly. The drive motor 5 rotates in a first direction to open the doors, and rotates in an opposite direction to close the doors. In one embodiment, a light source 11 and light receiver 12 are arranged to detect the presence of an operator approaching the doors 1. It is noted that in other embodiments, different sensor arrangements, such as infra-red, motion sensitive, or other types, may be substituted for the light source 11 and light receiver 12 elements. Detection of an operator near the doors 1 causes a signal to be dispatched to the controller 8, which signals the drive motor 5 to open the doors 1. After the operator moves away from the doors 1, the drive motor 5 is signalled to close the doors 1.

Figure 2:
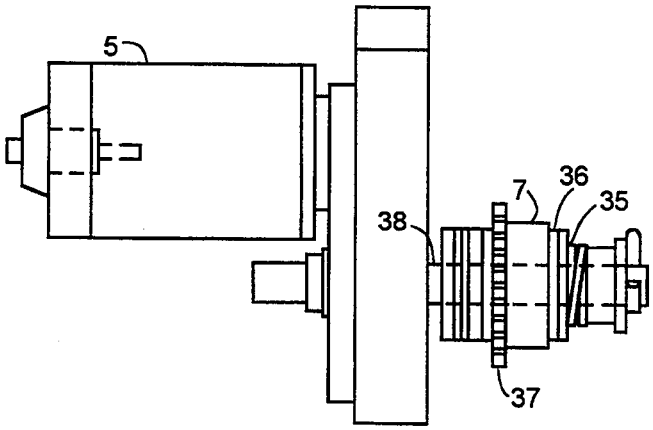
FIG. 2 is a side elevation view of the motor and clutch arrangement.

Referring now to FIG. 2, a side elevation view of the drive motor 5/clutch assembly 7 is shown. The drive motor 5 transfers mechanical power to the drive cable 2 arrangement through the clutch 7. The clutch 7 includes an adjustable clutch spring 35 and a clutch plate 36. In the event that the doors 1 and drive cable 2 are impeded in their motion while the drive motor 5 is urging motion, the clutch plate 36 allows slippage of the drive pulley 37 with respect to the drive shaft 38. This in turn results in a cessation of relative movement between the doors 1, until the obstruction is removed.

Figure 3:
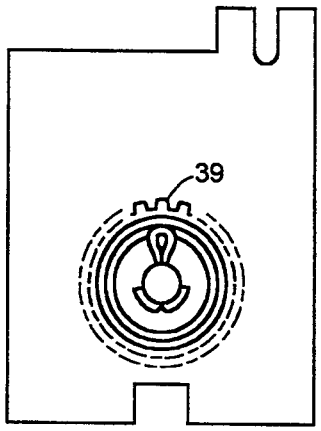
FIG. 3 is a front elevation view of the motor and clutch arrangement.

Referring now to FIG. 3, a front elevation view of the drive motor 5/clutch assembly 7 is shown. In one embodiment, the drive means for the drive cable 2 is a gear 39.

Figure 4:
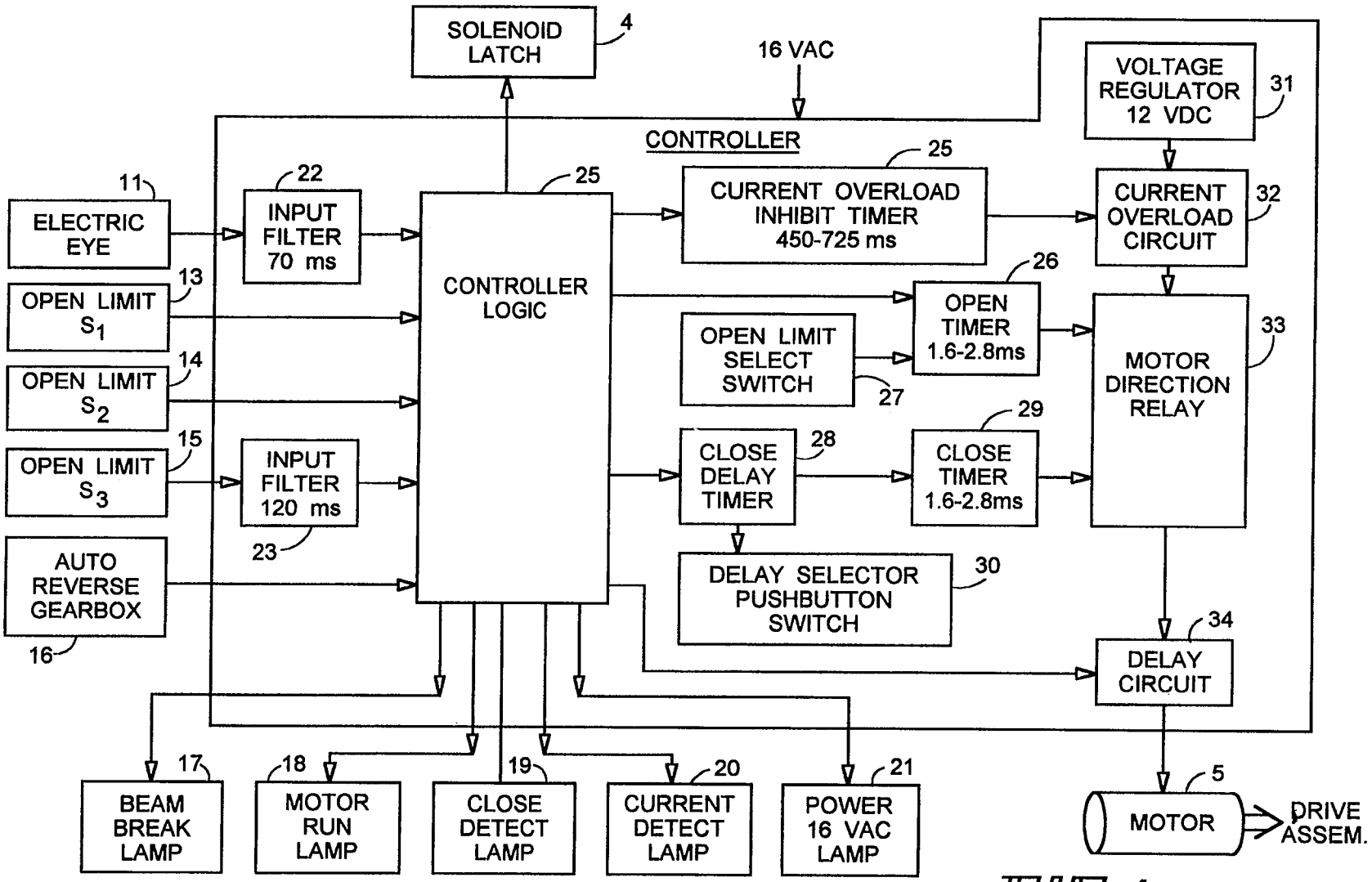
FIG. 4 is a schematic diagram of the control system of the present invention.

Referring now to FIG. 4, a schematic diagram for the control system of the present invention is shown. The controller 8 includes a controller logic circuit 24. A detector 40 senses the presence of an operator approaching the doors 1, and sends a signal through the input filter 22, which discriminates insignificant inputs to the detector 40, before the signal travels to the logic circuit 24. The solenoid latch 4 unlocks the doors 1. After the open timer 26 and the delay circuit 34 cycle, the motor direction relay 33 completes the circuit to the drive motor 5, which acts upon the drive cable 2 to open the doors 1.

Through selective inputs, the open limit select switch 27 controls the size of the door opening, by activating one of a plurality of open limit switches, such as 13, 14. A current overload inhibit timer 25, a voltage regulator 31, and a current overload circuit 32 may be included in the motor circuit. When the presence of the operator is no longer detected, a signal is sent to the drive motor 5 to close the doors 1. A delay selector switch 30 allows selection of various close delay timer 28 and close timer 29 settings.

Upon actuation of the close limit switch 15 by the door 1, the input filter 23 momentarily delays the cessation of door closure movement, thereby ensuring a tight seal between the doors 1.

Auto-reverse sensor 16 detects any obstruction to the closing of the doors, and, in that case, acts to reverse the direction of the drive motor 5. This feature is significant from a safety standpoint, as it reduces the likelihood that the operator or merchandise will be caught between the closing doors 1.

A beam break lamp 17, motor run lamp 18, close detect lamp 19, current detect lamp 20, and power lamp 21 are also provided, for diagnostic purposes.

Figure 5:
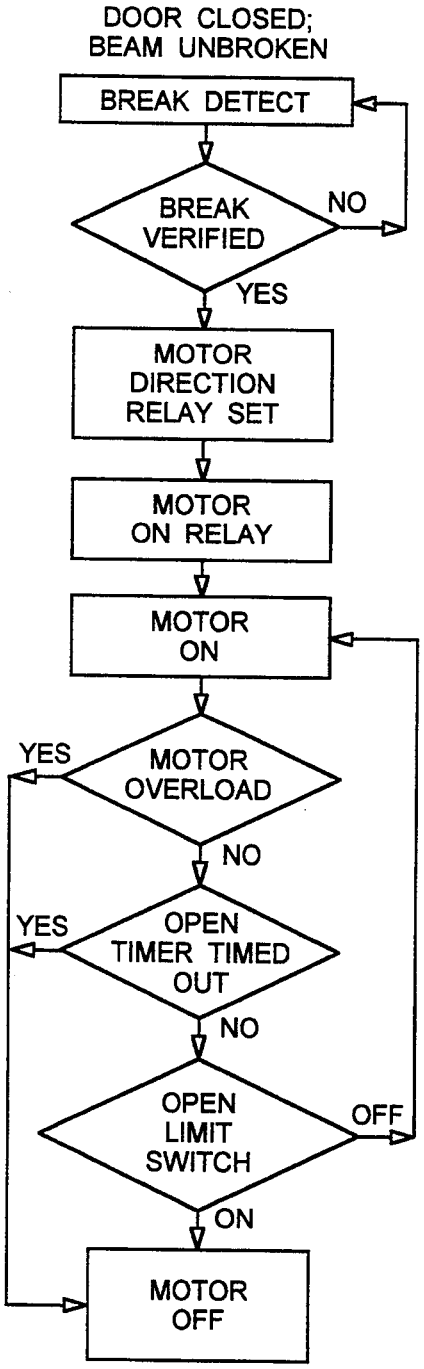
FIG. 5 is a schematic diagram of the door arrangement in the door closed position.

Referring now to FIG. 5, a schematic diagram of the door arrangement, in the door-closed position, is shown. In one embodiment, the detector 40 is a light source 11-light receiver 12 circuit. When the light beam is broken, the broken beam is verified, the motor direction relay is set, the motor-on delay 34 cycles, and the drive motor 5 is activated. If the motor overload circuit 32, the open timer 26, or one of the open limit switches 13, 14 are closed, the drive motor is deactivated.

Figure 6:
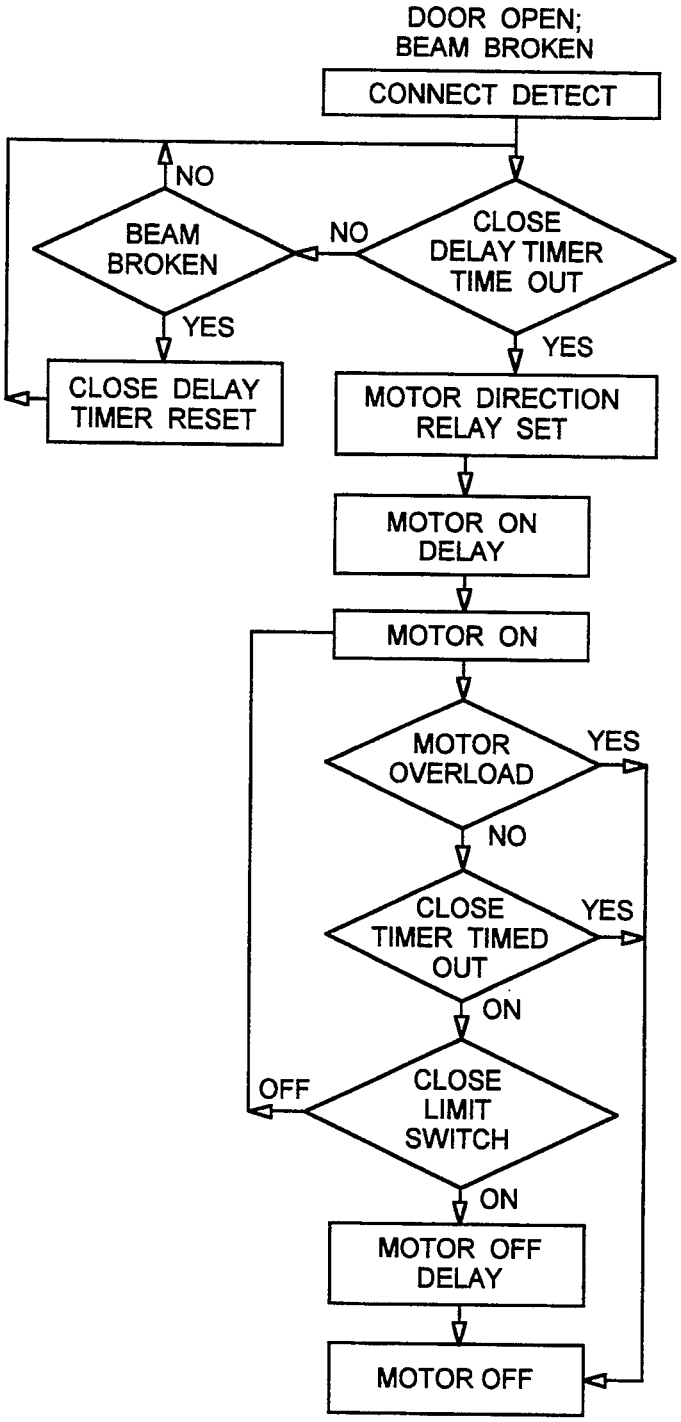
FIG. 6 is a schematic diagram of the door arrangement in the door open position.

Referring now to FIG. 6, a schematic diagram of the door arrangement, in the door open position, is shown. In one embodiment, the detector 40 is a light source 11-light receiver 12 circuit. When the light beam connection is reestablished, the close delay timer 29 cycles, the motor direction relay 33 is set, the motor-on delay 34 cycles, and the drive motor 5 activated. If the motor overload circuit 32, the close timer 29, or the close limit switch 15 are closed, the drive motor 5 stops.

Although a particular embodiment of the present invention has been described in the foregoing detailed description, it will be understood that the present invention is not limited to the embodiment disclosed, but is capable of numerous modifications, rearrangements, and substitution of parts without departing from the spirit of the invention.

What is claimed is:

1. An automatically actuated door arrangement comprising:

a plurality of substantially vertically disposed sliding doors, said doors arranged in substantially the same plane and slidable in a substantially horizonal direction, a door track for supporting said doors, said door track is arranged in a shallow "V" shape, whereby said doors are lifted slightly up as they move from a closed to an open position, door bearings disposed on said doors, said door bearings riding in said door track, a drive cable attached to said doors, a reversible drive motor associated with said drive cable, a clutch assembly associated with said drive motor, said drive motor acting through said drive cable to alternately open and close said doors, a detector arranged and constructed to sense the entry of an operator into an area adjacent said doors, position limiting means to control the position of said doors, a controller arranged and constructed to control the opening the closing of said doors, said controller having a plurality of operating parameter indicators, wherein the movement of an operator into an area adjacent said doors causes the doors to open, and the movement of the operator away from said doors causes the doors to close and a solenoid operated latch arranged and constructed to lock the doors together when closed, and to automatically unlock as the doors begin to open.

2. An automatically actuated door arrangement according to claim 1, wherein said clutch assembly comprises an adjustable clutch spring, a clutch plate, and a drive pulley.

3. An automatically actuated door arrangement according to claim 2, wherein said detector comprises a light source and a light receiver.

4. An automatically actuated door arrangement according to claim 2, wherein said detector comprises a motion sensor.

5. An automatically actuated door arrangement according to claim 2, wherein said position limiting means comprises a plurality of open limit switches for limiting opening movement of said doors, an open limit switch selector for selection between various opening sizes, a close limit switch for determining the point of closure, and an autoreverse switch for sensing obstructions to door closure and for sending a reverse door direction signal to said drive motor.

6. An automatically actuated door arrangement according to claim 5, wherein said operating parameter indicators comprise a beam break indicator, a motor run indicator, a close detect indicator, a current detect indicator, and a power indicator.

7. An automatically actuated door arrangement according to claim 6, wherein said drive motor is arranged and constructed to open said doors at a higher relative rate of speed with respect to the closing rate.

8. An automatically actuated door arrangement according to claim 7, wherein all input and output connections between said drive motor, said solenoid latch, said limit switches, and said controller are modular.

* * * * *